US005697343A

United States Patent [19]

Isozumi et al.

[11] Patent Number: 5,697,343

[45] Date of Patent: Dec. 16, 1997

[54] FUEL INJECTOR SYSTEM

[75] Inventors: Shuzo Isozumi; Hideki Morikaku, both of Tokyo, Japan

[73] Assignee: Mitsubishi Denki Kabushiki Kaisha, Tokyo, Japan

[21] Appl. No.: 794,023

[22] Filed: Feb. 3, 1997

[30] Foreign Application Priority Data

Jul. 8, 1996 [JP] Japan ..... 8-177834

[51] Int. Cl.[6] ..... F02M 37/04

[52] U.S. Cl. ..... 123/446; 123/456

[58] Field of Search ..... 123/446, 447, 123/456, 497

[56] References Cited

U.S. PATENT DOCUMENTS

| | | | |
|---|---|---|---|
| 4,777,921 | 10/1988 | Miyaki et al. . | |
| 5,058,553 | 10/1991 | Kondo | 123/446 |
| 5,094,216 | 3/1992 | Miyaki et al. . | |
| 5,186,138 | 2/1993 | Hashimoto | 123/456 |
| 5,197,438 | 3/1993 | Yamamoto | 123/446 |
| 5,313,924 | 5/1994 | Regufiro | 123/446 |
| 5,404,855 | 4/1995 | Yen | 123/446 |
| 5,441,027 | 8/1995 | Buchanon | 123/446 |

FOREIGN PATENT DOCUMENTS 1267355 10/1989 Japan .

*Primary Examiner*—Carl S. Miller

*Attorney, Agent, or Firm*—Sughrue, Mion, Zinn, Macpeak & Seas, PLLC

[57] ABSTRACT

A fuel injector system permits easier control for turning ON/OFF a spill control solenoid valve of a high pressure supply pump. The cam has a greater number of rising slopes for pressurizing the fuel by the plunger than the number of the fuel injection for each rotation of the engine. An electronic control unit controls the closing timing of the spill solenoid valve so that the period of synchronous delivery which is synchronized with the fuel injection is longer than the period of asynchronous delivery which is not synchronized with the fuel injection. Further, the unit adjusts the closing timing of the spill solenoid valve according to engine load.

6 Claims, 8 Drawing Sheets

FUEL INJECTOR SYSTEM

BACKGROUND OF THE INVENTION

1. Field of the Invention

The present invention relates to a fuel injection system and, more particularly, to a high pressure fuel injector system which has a common rail and used in, for example, a diesel engine, etc.

2. Description of Related Art

A fuel injector system which is disclosed in U.S. Pat. No. 4,777,921 or U.S. Pat. No. 5,094,216 is known as a common-rail type fuel injector system.

The fuel injector system disclosed in U.S. Pat. No. 4,777,921 employs, as a high pressure pump, a variable-discharge pump which permits delivery stroke to be controlled by a spill solenoid valve. In the middle of the period of a delivery stroke during which the fuel in a pump chamber of the pump can be delivered, the spill solenoid valve is closed to forcibly feed the fuel from the pump chamber to a common rail and the spill solenoid valve is kept closed for a predetermined time, then the spill solenoid valve is opened in the middle of the delivery stroke to make the fuel flow into a low pressure fuel path, thereby controlling the fuel pressure in the common rail to a predetermined pressure level.

The fuel injector system proposed in U.S. Pat. No. 5,094,216 employs, as a high pressure pump, a variable-discharge pump which permits the delivery stroke to be controlled by an outopening type spill solenoid valve. In the middle of a stroke during which the delivery is possible in the pump, the solenoid valve is closed to deliver the fuel from the pump chamber into the common rail and the spill solenoid valve is kept closed until the end of the delivery stroke of the pump, and the energizing timing for opening the spill solenoid valve is controlled so as to control the fuel pressure in the common rail to a predetermined pressure level.

The conventional fuel injector systems have posed a problem in that the pressure fluctuation in the common rail which corresponds to the injection pressure applied to a diesel engine, etc. increases. More specifically, the injection pressure wave of a preceding injection of a fuel injector system interferes with the pressure wave produced by the following injection and pump delivery, leading to increased fluctuations in the pressure in the common rail.

As the revolution speed is increased, the injection interval is shortened. Therefore, the amplitude of the pressure wave from the preceding injection accordingly increases, thus adding further to the fluctuation in the pressure in the common rail and also to the variations in injection amount, eventually leading to damage to the pump.

SUMMARY OF THE INVENTION

The present invention has been made with a view toward solving the problems discussed above and it is an object of the present invention to provide a fuel injector system which is capable of maintaining stable high common rail pressure with minimized fluctuation in the pressure and also minimized variations in injection amount regardless to an engine load or an engine speed.

In order to achieve the above object, according to one aspect of the present invention, there is provided a fuel injector system which is equipped with: a common rail for accumulating pressurized fuel; an injection nozzle for injecting fuel in the common rail into an engine cylinder, a high pressure supply pump having a pump chamber into which the fuel flows and a plunger for pressurizing the fuel in the pump chamber, the high pressure supply pump delivering the pressurized fuel in the pump chamber into the common rail and pressurizing the fuel in the common rail; a spill solenoid valve which is provided in a path communicating the pump chamber with a low pressure fuel path and which, when opened, communicates the pump chamber with the low pressure fuel path and, when closed, delivers the fuel from the pump chamber into the common rail; a cam which is secured to a driving shaft driven by the engine and which is provided with a plurality of rising slopes for driving the plunger so as to pressurize the fuel, the number of the rising slopes being greater than the number of fuel injections of the injection nozzle for each rotation of the engine; and control means for controlling the opening and closing of the spill solenoid valve, wherein the control means controls the closing timing of the spill solenoid valve during each period of time in which the delivery is possible in one rotation of the cam so that the spill solenoid valve is held closed longer during each synchronous delivery in which the delivery is synchronized with the fuel injection of the injection nozzle and that the spill solenoid valve is held closed shorter during each asynchronous delivery in which the delivery is not synchronized with the fuel injection of the injection nozzle, and the control means also controls the closing timing of the spill solenoid valve to adjust periods of the synchronous and asynchronous deliveries in accordance with the load on the engine, thereby maintaining the fuel pressure in the common rail to a predetermined pressure level.

According to another aspect of the present invention, there is provided a fuel injector which is equipped with: a common rail for accumulating pressurized fuel; an injection nozzle for injecting fuel in the common rail into an engine cylinder; a high pressure supply pump having a pump chamber into which the fuel flows and a plunger for pressurizing the fuel in the pump chamber, the high pressure supply pump delivering the pressurized fuel in the pump chamber into the common rail and pressurizing the fuel in the common rail; a spill solenoid valve which is provided in a path communicating the pump chamber with a low pressure fuel path and which, when opened, communicates the pump chamber with the low pressure fuel path and, when closed, delivers the fuel from the pump chamber into the common rail; a cam which is secured to a driving shaft driven by the engine and which is provided with a plurality of rising slopes for driving the plunger so as to pressurize the fuel, the number of the rising slopes being greater than the number of fuel injections of the injection nozzle for each rotation of the engine; and control means for controlling the opening and closing of the spill solenoid valve, wherein the control means controls the closing timing of the spill solenoid valve during each period of time in which the delivery is possible in one rotation of the cam so that the period of synchronous delivery which is synchronized with the fuel injection of the injection nozzle is equal to the entire period of time in which the delivery is possible and the period of asynchronous delivery which is not synchronized with the fuel injection of the injection nozzle is equal to a part of the period of time in which the delivery is possible, and the control means also controls the closing timing of the spill solenoid valve to adjust the period of the asynchronous delivery in accordance with the load on the engine, thereby maintaining the fuel pressure in the common rail to a predetermined pressure level.

DESCRIPTION OF THE PREFERRED EMBODIMENT

The embodiments of the present invention will be described below in conjunction with the accompanying drawings.

Figure 1:
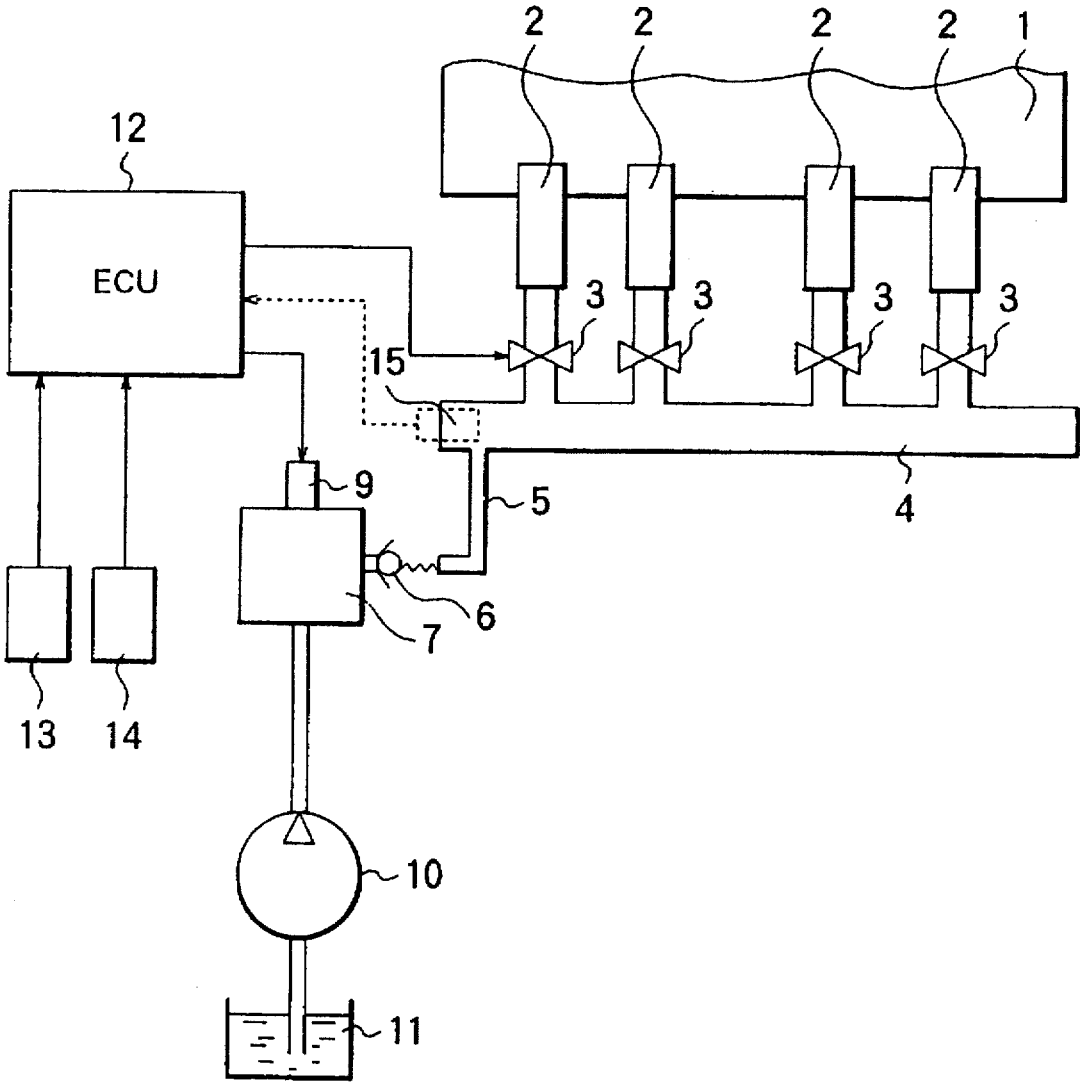
FIG. 1 is a schematic block diagram showing a fuel injector system in accordance with a first embodiment of the present invention.

First Embodiment:

FIG. 1 is a schematic block diagram showing a common rail type fuel injector system in accordance with a first embodiment of the present invention.

In the drawing, an engine 1 is a four-cylinder diesel engine of four strokes. The combustion chamber of each cylinder of the engine 1 has an injector 2 serving as an injection nozzle. An injection control solenoid valve 3 provided in each of the four injectors 2 is opened or closed to control the injection of fuel into the engine 4. A common rail 4 is a high pressure accumulator pipe common to all cylinders of the engine 1. The four injectors 2 are connected to the common rail 4, and the fuel in the common rail 4 is injected through the injectors 2 to the engine 1 when the injection control solenoid valves 3 are opened. The common rail 4 is connected to a check valve 6 provided on a high pressure supply pump 7 via a supply pipe 5. The high pressure supply pump 7 is driven by a cam driving mechanism 8 of the pump which will be described later in conjunction with FIG. 2 so as to deliver or forcibly feed the high pressure fuel to the common rail 4. The high pressure supply pump 7 is equipped with a spill control solenoid valve 9. The fuel is supplied to the high pressure supply pump 7 from a fuel tank 11 by a low pressure supply pump 10.

An electronic control unit 12 serving as the control means turns ON/OFF the injection control solenoid valves 3 and the spill control solenoid valve 9. The electronic control unit 12 receives the information on the speed and load of the engine 1 and the common rail pressure through an engine speed sensor 13, a load sensor 14, and a pressure sensor 15 which detects the common rail pressure. Specifically, in the common rail type fuel injector system, the information on the speed and load of the engine and the common rail pressure are supplied from the respective sensors 13, 14, and 15 to the electronic control unit 12 which controls a high pressure common rail system.

The electronic control unit 12 carries out negative feedback control of the common rail pressure while at the same time outputs a control signal to the injection control solenoid valves 3 so that the injection timing and the injection amount are adjusted to the optimum condition which are determined according to the state of the engine 1 which is judged by signals indicative of the information mentioned above. The unit 12 also sends a control signal to the spill control solenoid valve 9, thereby adjusting the common rail pressure to an optimum injection pressure level.

For instance, a certain amount of fuel in the common rail 4 whose pressure has been accumulated to 100 MPa is consumed each time for the injection control solenoid valves 3 is opened by a control pulse. To compensate for the consumed fuel, the high pressure supply pump 7 intermittently delivers the fuel to the common rail 4 by the amount required to compensate for the consumed amount in order to maintain the common rail pressure at the same 100 MPa level at all times. The required delivery amount varies depending on the injection amount or engine speed. Therefore, the amount of one delivery of the high pressure supply pump 7 is adjusted by controlling the operation of the spill control solenoid valve 9 by the electronic control unit 12. To perform the high pressure supply, maintenance, and control, the fuel is supplied in synchronization with a single operation cycle of the fuel injector, that is, for every injection. Therefore, a jerk type pump, which intermittently reciprocates and which is capable of performing more delivery cycles of fuel than the number of combustion cycles of the engine 1, is employed for the high pressure supply pump 7.

The high pressure supply pump 7 will now be described with reference to FIG. 2.

Figure 2:
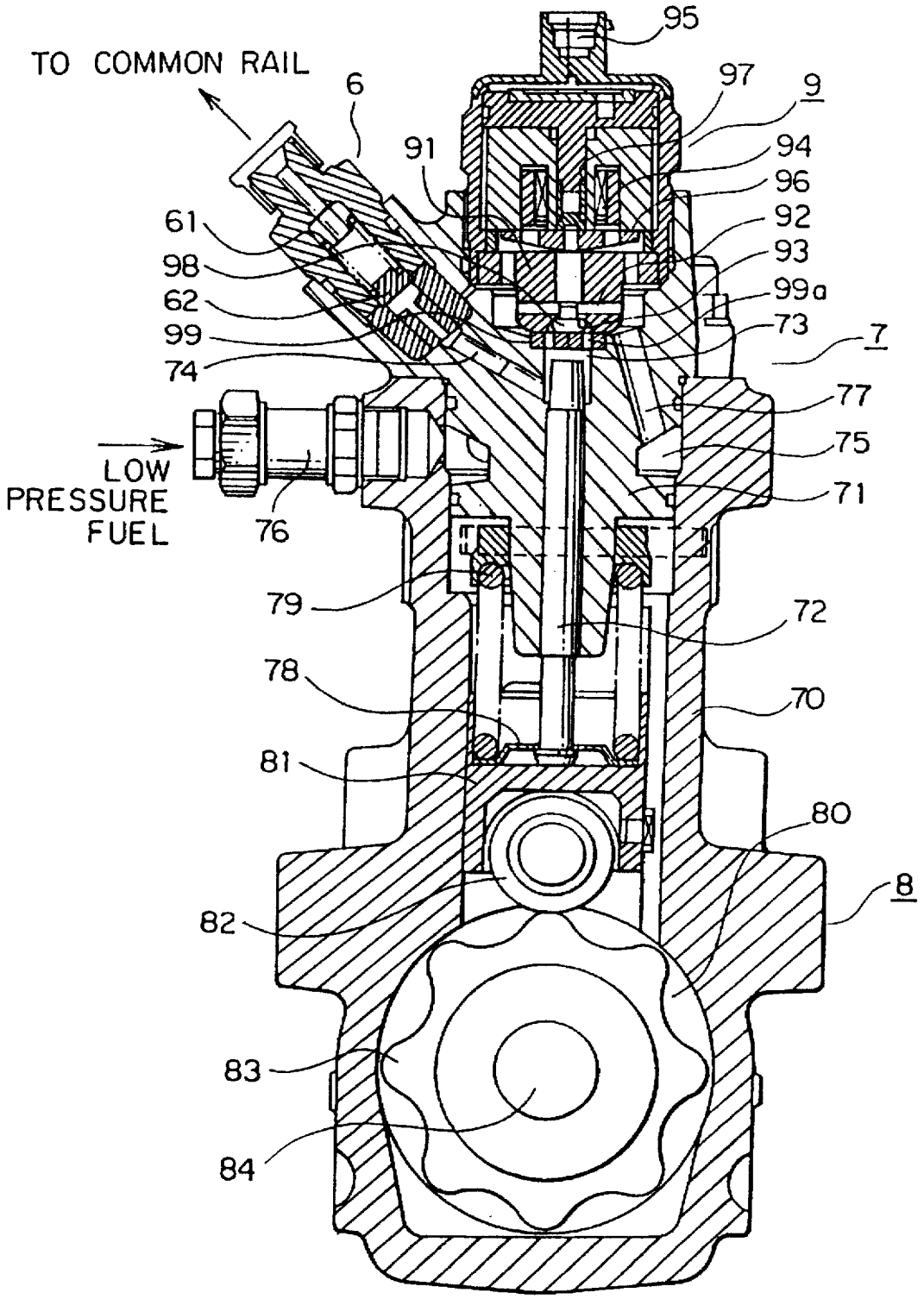
FIG. 2 is a sectional view showing a high pressure supply pump of the fuel injector system in accordance with the first embodiment of the present invention.

In FIG. 2, a cam chamber 80 of the pump driving mechanism 8 is provided at the bottom end of a pump housing 70 and a cylinder 71 is installed in the pump housing 70. A plunger 72 is installed in the cylinder 71 in such a manner that it can reciprocate and slide therein. The top end surface of the plunger 72 and the inner peripheral surface of the cylinder 71 constitute a pump chamber 73 which is communicated with the check valve 6 via a discharge port 74 serving as a communicating passage. The high pressure supply pump 7 is provided with a fuel reservoir 75 to which the low pressure fuel is supplied by the low pressure fuel pump 10 from the fuel tank 11 via an introduction pipe 76. The fuel reservoir 75 and the spill control solenoid valve 9 are communicated through a passage 77. A valve seat 78 connected at the bottom end of the plunger 72 is pressed against a cam follower 81 by a plunger spring 79 and a cam roller 82 is integrally provided on the cam follower 81. A cam 83 is secured to a driving shaft 84 and is rotatably disposed in the cam chamber 80. The cam 83 is slidably in contact with the cam roller 82, the outer periphery thereof having a shape formed by eight identical hills or carving projections. The driving shaft 84 of the cam 83 rotates at a half speed of the engine 1.

Hence, when the cam 83 is rotated by the rotary shaft 84 of the cam 83, the plunger 72 starts reciprocating motion via the cam roller 82, the cam follower. 81, and the valve seat 78. The reciprocating stroke of the plunger 72 is determined by the difference in height between the top and bottom of the hills. As the plunger 72 reciprocates in the cylinder 71, the fuel on the low pressure side is taken into the pump chamber 73. The fuel which has been taken in is delivered or forcibly fed when the spill control solenoid valve 9, which will be discussed in detail later, is closed. When the solenoid valve is opened, some portion of the fuel is returned to the low pressure end.

The spill control solenoid valve 9 will now be described with reference to FIG. 2.

A body 91 has a passage 92 which is communicated with the passage 77 formed on the cylinder 71. A valve seat 93 is provided on the body 91 on the side closer to the pump chamber 73. An electromagnetic coil 94 which is energized via a lead wire 95 is provided on the top of the body An armature 96 is drawn upward in FIG. 2 by the magnetic force of the energized electromagnetic coil 94 against the urging force of a spring 97. An outopening valve 98 is connected to the armature 96 into one unit, and when the electromagnetic coil 94 is de-energized, the valve 98 is brought down to the bottom in FIG. 2 by the elastic force of the spring 97, causing the passage 92 to be communicated with the pump chamber 73. When the electromagnetic coil 94 is energized, the valve 98 is brought back in the valve seat 93 to shut off the passage between the passage 92 and the pump chamber 73. A stopper 99 is provided on the cylinder 71 to decide the bottom position of the outopening valve 98. The stopper 99 comes in contact with the bottom end of the outopening valve 98 to restrict the position of the outopening valve 98 when the electromagnetic coil 94 is de-energized, and it is provided with a plurality of through holes 99*a* through which fuel can flow.

The spill control solenoid valve 9 is a pre-stroke control type solenoid valve for setting the timing at which the outopening valve 98 is seated on the valve seat 93 to start the pressurization of the plunger 72.

The schematic configuration of the high pressure supply pump 7 and the pump driving mechanism 8 will now be described with reference to FIG. 3.

Figure 3:
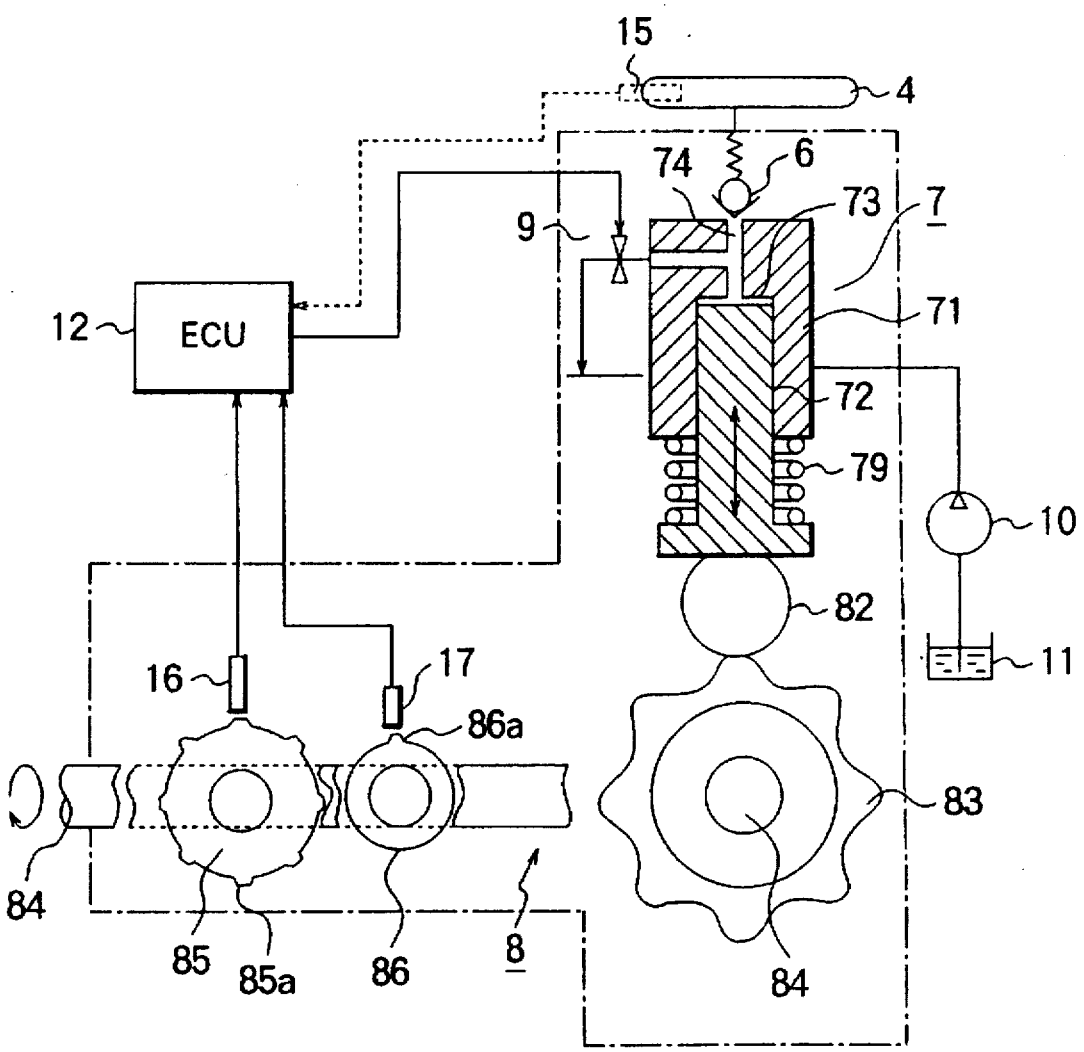
FIG. 3 is a schematic block diagram showing the high pressure supply pump and a pump driving mechanism of the fuel injector system in accordance with the first embodiment of the present invention.

In FIG. 3, a rotary disc 85 is coaxially attached to the driving shaft 84 of the cam 83. The rotary disc 85 has eight projections 85*a*. A cam angle sensor 16 which is an electromagnetic pickup is disposed facing against one of the projection 85*a*, so that every time one of the projection 85*a* passes near the cam angle sensor 16, a signal is sent to the electronic control unit 12. A cylinder identifying rotary disc 86 which has a single projection 86*a* is coaxially attached to the driving shaft 84 of the cam 83. A cylinder identifying sensor 17 is disposed facing against the projection 86*a*. Every time the projection 86*a* passes near the cylinder identifying sensor 17, that is, each time the high pressure supply pump 7 makes one reciprocating movement, one signal is sent to the electronic control unit 12. Based on the signals received from the cam angle sensor 16 and the cylinder identifying sensor 17, the electronic control unit 12 judges a bottom dead center of the plunger 72 of the high pressure supply pump 7.

In the configuration shown in FIG. 3, when, the plunger 72, which is reciprocated by the rotation of the driving shaft 84, comes down, the spill control solenoid valve 9 is open and the fuel is introduced into the pump chamber 73 via the low pressure supply pump 10 and the spill control solenoid valve 9 from the fuel tank 11. When the plunger 72 goes up, it attempts to pressurize the fuel in the pump chamber 73. At this time, if the spill control solenoid valve 9 is not energized, then the outopening valve 98 is apart from the valve seat 93 and the valve 9 is opened, and the fuel in the pump chamber 73 overflows via fuel passages 92, 77, the fuel reservoir 75, and the introduction pipe 76 in the order in which they are listed.

When a control pulse is sent to the spill control solenoid valve 9 to energize the spill control solenoid valve 9, the outopening valve 98 is seated in the valve seat 93 and the valve 9 is closed. This causes the plunger 72 to pressurize the fuel in the pump chamber 73. As soon as the fuel pressure in the pump chamber 73 overcomes the urging force of the spring 61 disposed on the check valve 6, the fuel delivered via the discharge port 74 pushes a valve 62 open, so that it is delivered into the common rail 4.

The operation of the fuel injector system, which is configured as mentioned above, will be described with reference to the timing chart shown in FIG. 4. The timing chart of FIG. 4 is indicative of the operation of the high pressure supply pump 7 for the period of one rotation of the pump, i.e., for the period of 360-degree rotation of the cam.

The fuel injector system is designed to, inject the fuel in the common rail 4 into the respective cylinders of the four-cylinder engine 1 in sequence through the four injectors 2, and the cam 83 has eight hill-shaped projections to provide eight delivery strokes of the high pressure supply pump 7. In the timing chart shown in FIG. 4, cam angle signals $C_1$, $C_3$, $C_5$, and $C_7$ are synchronized with the fuel injection of the injectors 2.

Figure 4:
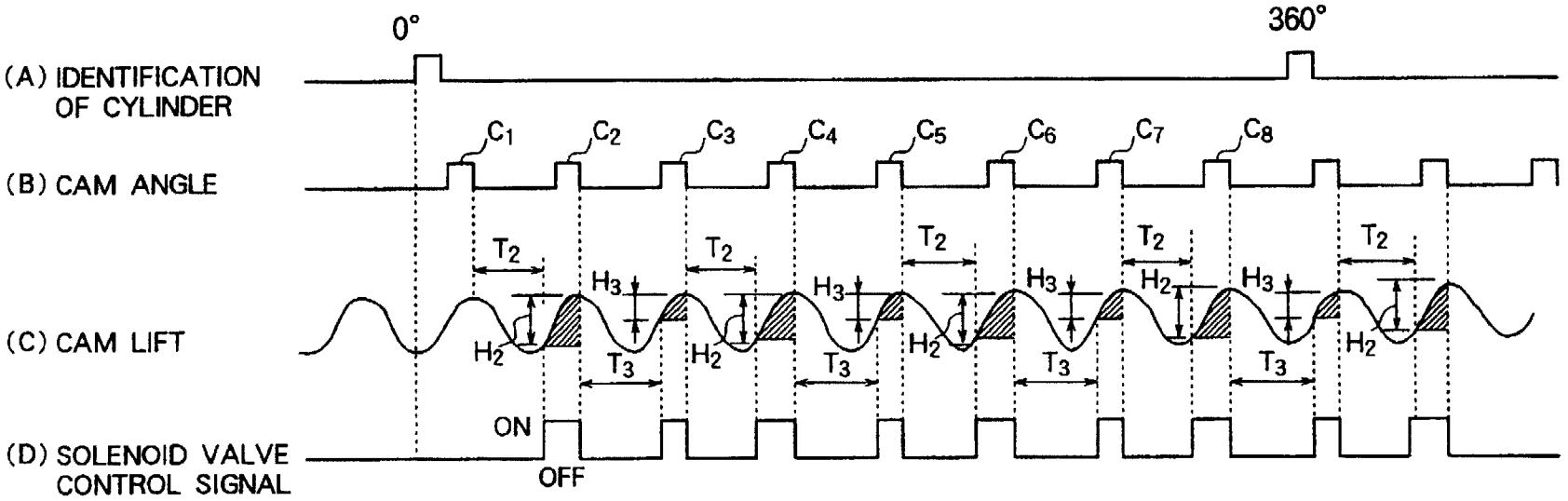
FIG. 4 is a timing chart showing the operation of the high pressure supply pump in the fuel injector system in accordance with the first embodiment of the present invention.

In FIG. 4, (A) indicates the signal of the cylinder identifying sensor 17 and (B) indicates the signal of the cam angle sensor 16. Based on the signals received from the two sensors 16 and 17, the electronic control unit 12 determines and inputs a signal indicative of the bottom dead center of the plunger 72 of the high pressure supply pump 7. (C) indicates the lift amount of the cam 83 and (D) denotes the control signal of the spill control solenoid valve 9. In the high pressure supply pump 7, eight delivery strokes, during which the fuel delivery is possible, take place while the driving shaft 84 makes one complete rotation.

When the cam 83 is driven and a time $T_2$ has passed from the trailing edge of the cam angle signal $C_1$, the electronic control unit 12 sends a control signal to the spill control solenoid valve 9, and the control signal is cut off at the trailing edge of the following cam angle signal $C_2$. While the control signal is being applied, the spill control solenoid valve 9 is held closed. Thus, the fuel in the pump chamber 73 which has been pressurized by the plunger 72 for a cam lift amount $H_2$ after the solenoid valve 9 was closed (indicated by the hatched sections in FIG. 4) flows into the common rail 4 via the check valve 6 and it is accumulated in the common rail 4.

Then, when a time $T_3$ has passed from the trailing edge of the cam angle signal $C_2$, the electronic control unit 12 sends a control signal to the spill control solenoid valve 9, and the control signal is cut off at the trailing edge of the following cam angle signal $C_3$. Thus, the fuel in the pump chamber 73 which has been pressurized by the plunger 72 for a cam lift amount $H_3$ (indicated by the hatched sections in FIG. 4) flows into the common rail 4 via the check valve 6 and it is accumulated in the common rail 4.

Likewise, when the time $T_2$ has respectively passed from the trailing edges of the cam angle signals $C_3$, $C_5$, and $C_7$, the electronic control unit 12 sends control signals to the spill control solenoid valve 9, and these control signals are cut off at the trailing edges of the following cam angle signals $C_4$, $C_6$, and $C_8$, respectively. Further, when the time $T_8$ has passed from the trailing edges of the cam angle signals $C_4$, $C_6$, and $C_8$, the electronic control unit 12 sends control signals to the still control solenoid valve 9, and these control signals are cut off at the trailing edges of the following cam angle signals $C_5$, $C_7$, and $C_1$, respectively.

In the first embodiment, the spill control solenoid valve 9 is opened when the plunger 72 has arrived at the top dead center thereof. The times $T_2$ and $T_3$ are set up so as to close the valve 9 at any point during which the plunger 72 shifts from the bottom dead center to the top dead center thereof, that is, which the fuel delivery is possible (where the time $T_2$<time $T_3$).

Thus, according to the first embodiment, in the fuel injector system which is adapted to inject the fuel in the common rail 4 into the respective cylinders of the four-cylinder engine 1 in sequence by the four injectors 2, the cam 83 is provided with eight hill-shaped projections to set the number of the delivery strokes of the high pressure supply pump 7 to eight, and the electronic control unit 12 holds the spill control solenoid valve 9 closed longer during the delivery strokes which are synchronized with the fuel injection of the injectors 2 so as to increase the fuel delivery amount of the pump, while it holds the spill control solenoid valve 9 closed shorter during the delivery strokes which are not synchronized with the fuel injection of the injectors 2 so as to reduce the fuel delivery amount of the pump. Further, the times $T_2$ and $T_3$ are adjusted according to the load on the engine, thereby permitting the control of the amount of fuel to be delivered for generating or maintaining the common rail pressure so as to reach the desired common rail pressure.

Furthermore, pump delivery in more amount corresponding to the cam lift amount $H_2$ and pump delivery in less amount corresponding to the cam lift amount $H_3$ are carried out for one fuel injection, and pump delivery pressure waves of two different amplitudes are generated. The pressure waves having the two different amplitudes counteract each other, making it possible to restrain the fluctuations in the common rail pressure and also the variations in the fuel injection amount.

Moreover, since the pump delivery is performed twice for one fuel injection, the amplitude of the pressure wave per pump delivery is smaller, allowing the fluctuation in the common rail pressure to be restrained, which fluctuation is caused by the interference among the pressure waves of the fuel injection and pump delivery.

In the first embodiment, both times $T_2$ and $T_3$ are adjusted in accordance with the load on the engine. As an alternative, however, either sending time $T_2$ or $T_3$ may be fixed and only the other one may be adjusted, this would simplify the control for turning ON/OFF the spill control solenoid valve 9.

Figure 5:
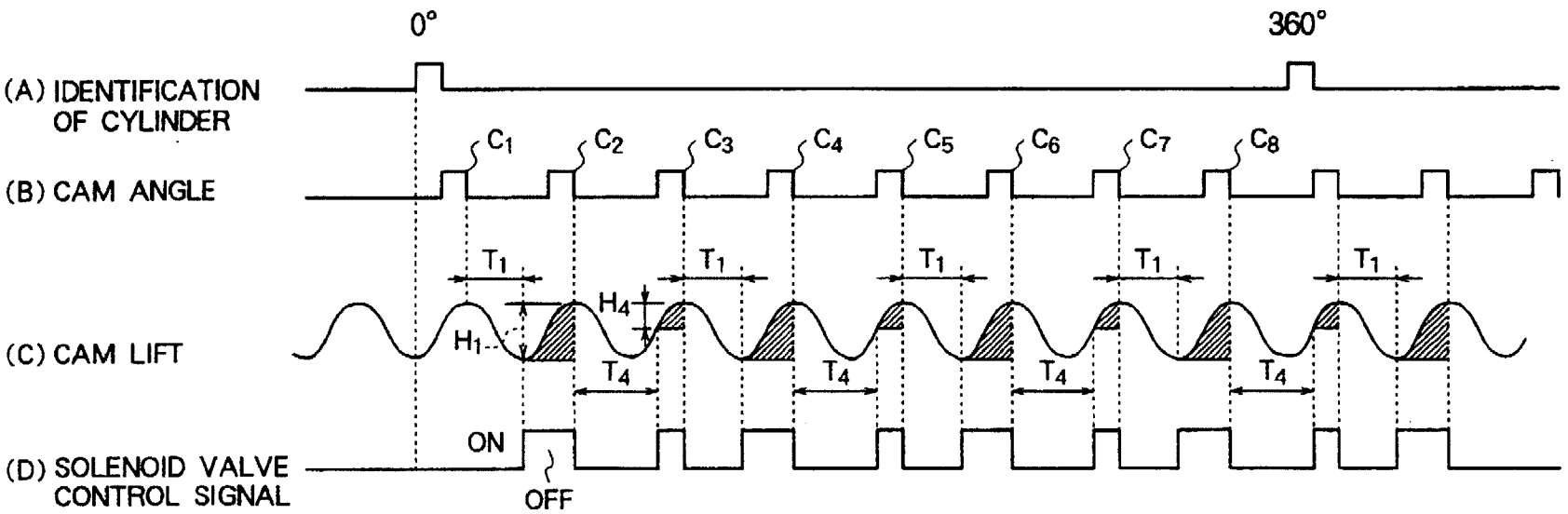
FIG. 5 is a timing chart showing the operation of a high pressure supply pump in a fuel injector system in accordance with a second embodiment of the present invention.

Second Embodiment:

FIG. 5 is a timing chart illustrative of the operation of the high pressure supply pump in a fuel injector system in accordance with a second embodiment of the present invention, and it shows the operation of about one rotation of the pump, that is, 360-degree rotation of the cam. This fuel injector system shares the same configuration as that of the first embodiment.

The fuel injector system is designed to inject the fuel in the common rail 4 into the respective cylinders of the four-cylinder engine 1 in sequence through the four injectors 2. The cam 83 has eight hill-shaped projections to provide eight delivery strokes of the high pressure supply pump 7. In the timing chart shown in FIG. 5, cam angle signals $C_1$, $C_3$, $C_5$, and $C_7$ are synchronized with the fuel injection of the injectors 2.

In the second embodiment, when the cam 83 is driven and the time $T_1$ has passed from the trailing edge of the cam angle signal $C_1$, that is, when the plunger 72 has arrived the bottommost position, namely the bottom dead center thereof, the electronic control unit 12 sends a control signal to the spill control solenoid valve 9. The control signal is cut off at the trailing edge of the following cam angle signal $C_2$, that is, when the plunger 72 has arrived at the top dead center thereof. While the control signal is being applied, the spill control solenoid valve 9 is held closed. Thus, the fuel in the pump chamber 73 which has been pressurized by the plunger 72 for the cam lift amount $H_1$ after the solenoid valve 9 was closed flows into the common rail 4 via the check valve 6 and it is accumulated in the common rail 4.

Then, when a time $T_4$ has passed from the trailing edge of the cam angle signal $C_2$, the electronic control unit 12 sends a control signal to the spill control solenoid valve 9. The control signal is cut off at the trailing edge of the following cam angle signal $C_3$, that is, when the plunger 72 has arrived at the top dead center thereof. Thus, the fuel in the pump chamber 73 which has been pressurized by the plunger 72 for a cam lift amount $H_4$ flows into the common rail 4 via the check valve 6 and it is accumulated in the common rail 4.

Likewise, when the time $T_1$ has passed from the trailing edges of the cam angle signals $C_3$, $C_5$, and $C_7$, the electronic control unit 12 sends control signals to the spill control solenoid valve 9 and these control signals are cut off at the trailing edges of the following cam angle signals $C_4$, $C_6$, and $C_8$, respectively. Further, when the time $T_4$ has passed from the trailing edge of the cam angle signals $C_4$, $C_6$, and $C_8$, the electronic control unit 12 sends control signals to the spill control solenoid valve 9 and these control signals are cut off at the trailing edges of the following cam angle signals $C_5$, $C_7$, and $C_1$, respectively (where the time $T_1$<time $T_4$).

In the second embodiment, the time $T_1$ is set up so as to close the spill control solenoid valve 9 at a point of time when the plunger 72 has arrived at the bottom dead center thereof. The time $T_4$ is set up so as to close the spill control solenoid valve 9 at any point during which the plunger 72 shifts from the bottom dead center to the top dead center thereof, that is, which the delivery is possible.

Thus, according to the second embodiment, in the fuel injector system which is adapted to inject the fuel in the common rail 4 into the respective cylinders of the four-cylinder engine 1 in sequence by the four injectors 2, the cam 83 is provided with eight hill-shaped projections to set the number of the delivery strokes of the high pressure supply pump 7 to eight. In the delivery strokes which are synchronized with the fuel injection of the injectors 2, the electronic control unit 12 holds the spill control solenoid valve 9 closed for the entire period of time of each stroke which the delivery is possible so as to increase the delivery amount of the pump. While it holds the spill control solenoid valve 9 closed shorter during the delivery strokes which are not synchronized with the fuel injection of the injectors 2 so as to reduce the delivery amount of the pump. Further, the time $T_4$ is adjusted according to the load on the engine, thereby permitting the control of the amount of fuel to be delivered for generating or maintaining the common rail pressure so as to reach the desired common rail pressure.

Furthermore, pump delivery in more amount corresponding to the cam lift amount Hi and pump delivery in less amount corresponding to the cam lift amount $H_4$ are carried out for one fuel injection, and pump delivery pressure waves of two different amplitudes are generated. The pressure waves having the two different amplitudes counteract each other, making it possible to restrain the fluctuations in the common rail pressure and also the variations in the fuel injection amount.

Moreover, since the pump delivery is performed twice for one fuel injection, the amplitude of the pressure wave per pump delivery is smaller, allowing the fluctuation in the common rail pressure to be restrained, which fluctuation is caused by the interference among the pressure waves of the fuel injection and pump delivery.

Securing the delivery amount of fuel necessary for generating or maintaining the common rail pressure in accordance with the engine load requires only the adjustment of the time $T_4$, thus allowing simplified control of turning ON/OFF the spill control solenoid valve 9.

Third Embodiment:

In the first embodiment described above, the high pressure supply pump 7, the cam 83, the cam roller 82, the spill control solenoid valve 9, etc. are provided one each. In this embodiment, however, these components are provided two each sharing the same capacities and shapes, namely, high pressure supply pumps 7 and 7A, cams 83 and 83A, cam rollers 82 and 82A, spill control solenoid valves 9 and 9A, etc.

Figure 6:
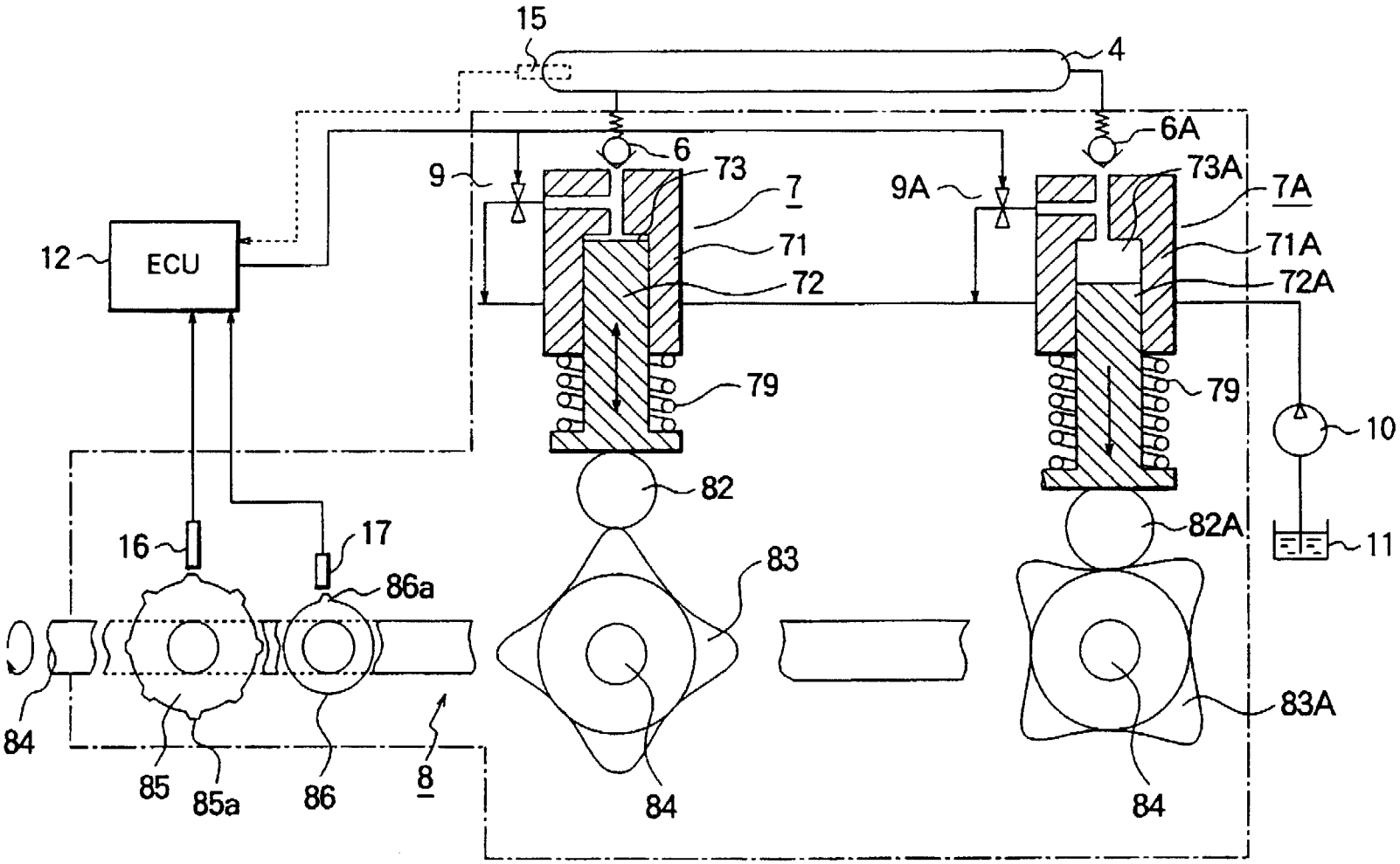
FIG. 6 is a schematic block diagram showing a common rail type fuel injector system in accordance with a third embodiment of the present invention.

In the third embodiment, the two cams 83 and 83A are formed to have the same shape and they have four hill-shaped projections which is the same number as the cylinders of the engine 1. The two cams 83 and 83A are coaxially mounted on the rotary shaft 84, but shifted by 45 degrees in angle in the rotational direction as illustrated in FIG. 6. These cams 83 and 83A respectively rotate in slidable contact with the cam rollers 82 and 82A to cause the plungers 72 and 72A to reciprocate, thus permitting the delivery strokes of the respective high pressure supply pumps 7 and 7A.

The fuel injector system is designed to inject the fuel in the common rail 4 into the respective cylinders of the four-cylinder engine 1 in sequence through the four injectors 2. In the fuel injector system, the two cams 83 and 83A which have four hill-shaped projections are coaxially mounted on the rotary shaft 84, but shifted by 45 degrees in angle with respect to each other in the rotational direction to provide eight strokes in which the delivery is possible. In the timing chart shown in FIG. 7, the cam angle signals $C_1$, $C_3$, $C_5$, and $C_7$ are synchronized with the injection through the injectors 2.

The operation of the fuel injector thus configured will be described with reference to the timing chart shown in FIG. 7.

Figure 7:
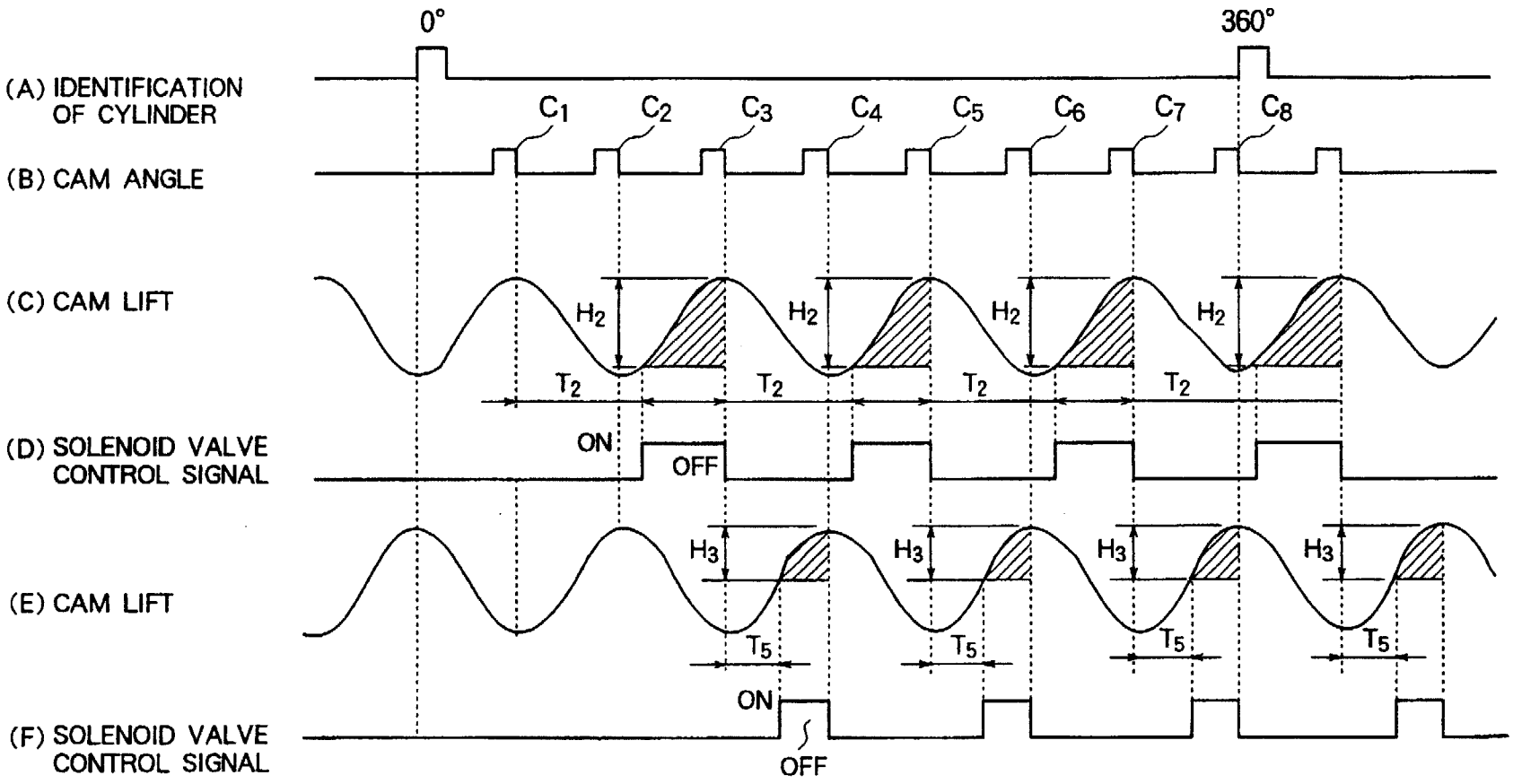
FIG. 7 is a timing chart showing the operation of a high pressure supply pump in the fuel injector system in accordance with the third embodiment of the present invention.

In FIG. 7, (A) indicates the signal of the cylinder identifying sensor 17 and (B) indicates the signal of the cam angle sensor 16. Based on the signals received from the two sensors 16 and 17, the electronic control unit 12 determines and inputs the signal indicative of the bottom dead center of the cylinder 71 of the high pressure supply pump 7. (C) indicates the lift amount of the cam 83, and four delivery strokes of force feed are implemented while the driving shaft 84 makes one complete rotation. (D) denotes the control signal of the spill control solenoid valve 9 which is mounted on the high pressure supply pump 7 where the delivery strokes are implemented through the cam 83. (E) denotes the lift amount of the cam 83A, and four delivery strokes are implemented while the driving shaft 84 makes one complete rotation. (F) denotes the control signal of the spill control solenoid valve 9A mounted on the high pressure supply pump 7A where the delivery strokes are implemented through the cam 83A.

According to the third embodiment; in the high pressure supply pump 7, when the cam 83 is driven and the time $T_2$ has passed from the trailing edge of the cam angle signal $C_1$, the electronic control unit 12 sends a control signal to the spill control solenoid valve 9, and the control signal is cut off at the trailing edge of the following cam angle signal $C_3$. Likewise, when the time $T_2$ has passed from the trailing edges of the cam angle signals $C_3$, $C_5$, and $C_7$, respectively, the electronic control unit 12 sends a control signal to the spill control solenoid valve 9, and these control signals are respectively cut off at the trailing edges of the following cam angle signals $C_5$, $C_7$, and $C_1$. While these control signals are being supplied, the spill control solenoid valve 9 is held closed. Thus, the fuel in the pump chamber 73 which has been pressurized by the plunger 72 for the cam lift amount $H_2$ after the solenoid valve 9 was closed flows into the common rail 4 via the check valve 6 and it is accumulated in the common rail 4.

In the high pressure supply pump 7A, when the cam 83A is driven and the time $T_5$ has passed from the trailing edge of the cam angle signal $C_3$, the electronic control unit 12 sends a control signal to the spill control solenoid valve 9A, and the control signal is cut off at the trailing edge of the following cam angle signal $C_4$. Likewise, when the time $T_5$ has elapsed from the trailing edges of the cam angle signals $C_5$, $C_7$, and $C_1$, respectively, the electronic control unit 12 sends a control signal to the spill control solenoid valve 9A and these control signals are respectively cut off at the trailing edges of the following cam angle signals $C_6$, $C_8$, and $C_2$. While these control signals are being supplied, the spill control solenoid value 9A is held closed. Thus, the fuel in the pump chamber 73A which has been pressurized by the plunger 72A for the cam lift amount after the solenoid valve 9A was closed flows into the common rail 4 via the check valve 6A and it is accumulated in the common rail 4.

In the third embodiment, the spill control solenoid valves 9 and 9A are respectively opened when the plungers 72 and 72A have arrived at the top dead center thereof The times $T_2$ and $T_5$ are set up so as to close the valves 9 and 9A at any point during which the plungers 72 and 72A shift from the bottom dead center to the top dead center, that is, which the fuel delivery is possible.

Thus, according to the third embodiment, the spill control solenoid valve 9 is held closed longer during the delivery strokes which are synchronized with the fuel injection of the injectors 2 so as to increase the delivery amount of the pump, while it holds the spill control solenoid valve 9A closed shorter during the delivery strokes which are not synchronized with the fuel injection of the injectors 2 so as to reduce the delivery amount of the pump. Hence, the operation of the third embodiment is similar to the fuel injector in the first embodiment, the operation of which is illustrated by the timing chart given in FIG. 4.

Hence, the third embodiment also provides the same advantages presented by the first embodiment described above.

Further, the times $T_2$ and $T_5$ are adjusted according to the load on the engine, thereby permitting the control of the amount of fuel to be delivered for generating or maintaining the common rail pressure so as to reach the desired common rail pressure.

Figure 8:
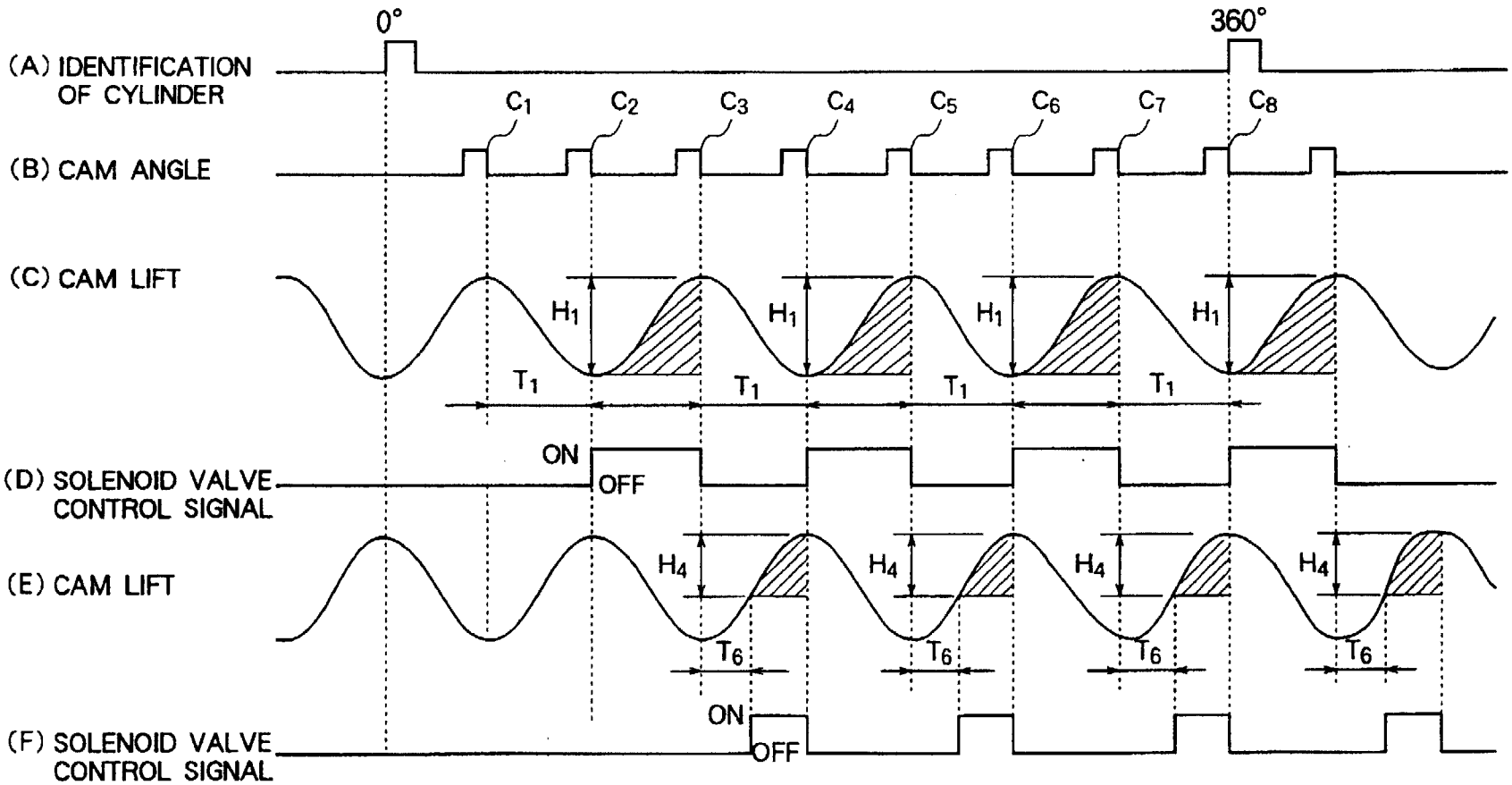
FIG. 8 is a timing chart showing the operation of a high pressure supply pump in a fuel injector system in accordance with the fourth embodiment of the present invention.

Fourth Embodiment:

FIG. 8 is a timing chart illustrative of the operation of the high pressure supply pump in a fuel injector system in accordance with a fourth embodiment of the present invention, and it shows the operation of about one rotation of the pump, that is, 360-degree rotation of the cam. This fuel injector system shares the same configuration as that of the third embodiment.

The fuel injector system is designed to inject the fuel in the common rail 4 into the respective cylinders of the four-cylinder engine 1 in sequence through the four injectors 2, the two cams 83 and 83A which have four hill-shaped projections are coaxially mounted on the rotary shafts 84, but shifted by 45 degrees in angle with respect to each other in the rotational direction to provide eight force feed strokes. In the timing chart shown in FIG. 8, the cam angle signals $C_1$, $C_3$, $C_5$, and $C_7$ are synchronized with the injection of the injectors 2.

According to the fourth embodiment, in the high pressure supply pump 7, when the cam 83 is driven and the time $T_1$ has passed from the trailing edges the cam angle signal $C_1$, that is, when the plunger 72 has arrived at the bottom dead center thereof, the electronic control unit 12 sends a control signal to the spill control solenoid valve 9, and the control signal is cut off at the trailing edge of the following cam angle signal $C_3$. Likewise, when the time $T_1$ has passed from the trailing edges of the cam angle signals $C_3$, $C_5$, and $C_7$, respectively, the electronic control unit 12 sends a control signal to the spill control solenoid valve 9, and these control signals are respectively cut off at the trailing edges of the following cam angle signals $C_5$, $C_7$, and $C_1$. While these control signals are being supplied, the spill control solenoid valve 9 is held closed. Thus, the fuel in the pump chamber 73 which has been pressurized by the plunger 72 for the cam lift amount $H_1$ after the solenoid valve was closed flows into the common rail 4 via the check valve 6 and it is accumulated in the common rail 4.

In the high pressure supply pump 7A, when the cam 83A is driven and the time $T_6$ has passed from the trailing edge of the cam angle signal $C_3$, the electronic control unit 12 sends a control signal to the spill control solenoid valve 9A, and the control signal is cut off at the trailing edge of the following cam angle signal $C_4$. Likewise, when the time $T_6$ has passed from the trailing edges of the cam angle signals $C_5$, $C_7$, and $C_1$, respectively, the electronic control unit 12 sends a control signal to the spill control solenoid valve 9A, and these control signals are respectively cut off at the trailing edges of the following cam angle signals $C_6$, $C_8$, and $C_2$. While these control signals are being supplied, the spill control solenoid valve 9A is held closed. Thus, the fuel in the pump chamber 73A which has been pressurized by the plunger 72A for the cam lift amount $H_4$ after the solenoid valve was closed flows into the common rail 4 via the check valve 6A and it is accumulated in the common rail 4.

In the fourth embodiment, the spill control solenoid valves 9 and 9A are respectively opened when the plungers 72 and 72A have arrived at the top dead center thereof. The time $T_1$ is set up so as to close the spill control solenoid valve 9 at a point of time when the plunger 72 has arrived at the bottom dead center thereof. The time $T_6$ is set up so as to close the spill control solenoid valve 9A at any point during which the plunger 72A shifts from the bottom dead center to the top dead center thereof, that is, which the fuel delivery is possible.

Thus, according to the fourth embodiment while the driving shafts 84 of the cams 83 and 83A makes one complete rotation, the spill control solenoid valve 9 is held closed for the entire period of time of each stroke in which the delivery is possible and which are synchronized with the fuel injection of the injectors 2 so as to increase the delivery amount of the pump. While it holds the spill control solenoid valve 9A closed shorter during the delivery strokes which are not synchronized with the fuel injection of the injectors 2 so as to reduce the delivery amount of the pump. Hence, the operation of the fourth embodiment is similar to that of the fuel injector system in the second embodiment, the operation of which is illustrated by the timing chart given in FIG. 5.

Hence, the fourth embodiment also provides the same advantages presented by the second embodiment described above.

In the fourth embodiment also, securing the delivery amount of fuel necessary for generating or maintaining the common rail pressure in accordance with the engine load requires only the adjustment of the time $T_6$, thus allowing simplified control of turning ON/OFF the spill control solenoid valve 9A.

In the first embodiment, the cam 83 is configured to have eight hill-shaped projections. The configuration of the cam 83, however, is not limited to eight hill-shaped projections, and it is acceptable as long as there are a greater number of hill-shaped projections than the number of the cylinders of the engine 1. Likewise, although the third embodiment uses the two cams 83 and 83A, each of which has four hill-shaped projections, the cams 83 and 83A are not limited to those having four hill-shaped projections and the number of the hill-shaped projections of the cams 83 and 83A is not necessarily the same, and it is acceptable as long as there are a greater number of projections than the number of the cylinders of the engine 1.

Furthermore, in the embodiments described above, the projections of the cams are formed equidistantly on the outer peripheries of the cams. However, the projections of the cams need not be formed equidistantly, they are acceptable as long as there are a greater number of cam projections than the number of the cylinders of the engine 1.

The present invention thus configured offers the advantages set forth below.

According to one aspect of the present invention, there is provided a fuel injector which is equipped with: a common rail for accumulating pressurized fuel; an injection nozzle for injecting the pressurizing fuel in the common rail into an engine cylinder; a high pressure supply pump having a pump chamber into which the fuel flows and a plunger for pressurizing the fuel in the pump chamber, the high pressure supply pump delivering the pressurized fuel in the pump chamber into the common rail and pressurizing the fuel in the common rail; a spill solenoid valve which is provided in a path communicating the pump chamber with a low pressure fuel path and which, when opened, communicates the pump chamber with the low pressure fuel path and, when closed, delivers the fuel from the pump chamber into the common rail; a cam which is secured to a driving shaft driven by the engine and which is provided with a plurality of rising slopes for driving the plunger so as to pressurize the fuel, the the number of the rising slopes being greater than the number of fuel injections of the injection nozzle for each rotation of the engine; and control means for controlling the opening and closing of the spill solenoid valve, wherein the control means controls the closing timing of the spill solenoid valve during each period of time which the delivery is possible in each rotation of the cam so that the spill solenoid valve is held closed longer during each synchronous delivery in which the delivery is synchronized with the fuel injection of the injection nozzle and that the spill solenoid valve is held closed shorter during each asynchronous delivery in which the delivery is not synchronized with the fuel injection of the injection nozzle, and the control means also controls the closing timing of the spill solenoid valve to adjust periods of the synchronous and asynchronous deliveries in accordance with the load on the engine, thereby maintaining the fuel pressure in the common rail to a predetermined pressure level. Therefore, the amount of fuel to be delivered to generate or maintain the common rail pressure can be accurately controlled, and the pressure waves of force feed in two different amplitudes interfere with and counteract each other. This permits restrained fluctuation in the pressure of the fuel in the common rail and accordingly enables the fuel injector system to perform proper fuel injection.

According to another aspect of the present invention, there is provided a fuel injector system which is equipped with: a common rail for accumulating pressurized fuel; an injection nozzle for injecting the pressurizing fuel in the common rail into an engine cylinder; a high pressure supply pump having a pump chamber into which the fuel flows and a plunger for pressurizing the fuel in the pump chamber, the high pressure supply pump delivering the pressurized fuel in the pump chamber into the common rail and pressurizing the fuel in the common rail; a spill solenoid valve which is provided in a path communicating the pump chamber with a low pressure fuel path and which, when opened, communicates the pump chamber with the low pressure fuel path and, when closed, delivers the fuel from the pump chamber into the common rail, a cam which is secured to a driving shaft driven by the engine and which is provided with a plurality of rising slopes for driving the plunger so as to pressurize the fuel, the the number of the rising slopes being greater than the number of fuel injections of the injection nozzle for each rotation of the engine; and control means for controlling the opening and closing of the spill solenoid valve, wherein the control means controls the closing timing of the spill solenoid valve during each period of time in which the delivery is possible in one rotation of the cam so that the period of synchronous delivery which is synchronized with the fuel injection of the injection nozzle is equal to the entire period of time in which the delivery is possible and the period of asynchronous delivery which is not synchronized with the fuel injection of the injection nozzle is equal to a part of the period of time in which the delivery is possible, and the control means also controls the closing timing of the spill solenoid valve to adjust the period of the asynchronous delivery in accordance with the load on the engine, thereby maintaining the fuel pressure in the common rail to a predetermined pressure level. Therefore, the amount of fuel to be delivered to generate or maintain the common rail pressure can be accurately controlled, and the pressure waves of force feed in two different amplitudes interfere with and counteract each other. This permits restrained fluctuation in the pressure of the fuel in the common rail and accordingly enables the fuel injector system to perform proper fuel injection.

Further according to the present invention, a greater number of projections than the number of fuel injections of the injection nozzle for one rotation of the engine are formed on the outer periphery of a single cam so as to provide a greater number of rising slopes for pressurizing fuel by the plunger than the number of fuel injections of the injection nozzle. Therefore, the number of plungers can be reduced, permitting a more compact fuel injector system.

Furthermore according to the present invention, a plurality of cams which are provided with a plurality of projections on the outer peripheries thereof are disposed on driving shafts so that they are shifted with respect to each other in a rotational direction to form a greater number of rising slopes for pressurizing fuel by the plunger than the number of fuel injections of the injection nozzle. Therefore, the number of projections of each cam can be reduced, permitting easier formation of the cams.

What is claimed is:

1. A fuel injector system for an engine comprising:

a common rail for accumulating pressurized fuel;

an injection nozzle for injecting the pressurized fuel in said common rail into an engine cylinder;

a high pressure supply pump having a pump chamber into which the fuel flows and a plunger for pressurizing the fuel in said pump chamber, said high pressure supply pump delivering the pressurized fuel in said pump chamber into said common rail and pressurizing the fuel in said common rail;

a spill solenoid valve which is provided in a path communicating said pump chamber with a low pressure fuel path and which, when opened, communicates said pump chamber with said low pressure fuel path and, when closed, delivers the fuel from said pump chamber into said common rail;

a cam which is secured to a driving shaft driven by the engine and which is provided with a plurality of rising slopes for driving said plunger so as to pressurize the fuel, the number of said rising slopes being greater than the number of fuel injections performed by said injection nozzle for each rotation of the engine; and control means for controlling the opening and closing of said spill solenoid valve, wherein said control means controls a closing timing of said spill solenoid valve during each period of time in which the delivery of the fuel is possible in one rotation of said cam, so that said spill solenoid valve is held closed for a longer period of time during each synchronous delivery, in which the delivery is synchronized with said fuel injection of said injection nozzle, than a period of time when said spill solenoid valve is held closed during each asynchronous delivery, in which the delivery is not synchronized with said fuel injection of said injection nozzle, and said control means also controls the closing timing of said spill solenoid valve to adjust periods of said synchronous and asynchronous deliveries in accordance with a load on the engine, thereby maintaining the fuel pressure in said common rail to a predetermined pressure level.

2. A fuel injector system according to claim 1, wherein the cam has more projections on an outer periphery of the cam than the number of fuel injections of said injection nozzle for one rotation of the engine, so that the number of rising slopes for pressurizing fuel by said plunger is greater than the number of fuel injections of said injection nozzle.

3. A fuel injector system according to claim 1, wherein a plurality of cams which are provided with a plurality of projections on the outer peripheries thereof are disposed on said driving shaft, the projections on each cam being shifted with respect to each other in a rotational direction to form a greater number of rising slopes for pressurizing fuel by said plunger than the number of fuel injections of said injection nozzle.

4. A fuel injector system for an engine comprising:

a common rail for accumulating pressurized fuel;

an injection nozzle for injecting the pressurized fuel in said common rail into an engine cylinder;

a high pressure supply pump having a pump chamber into which the fuel flows and a plunger for pressurizing the fuel in said pump chamber, said high pressure supply pump delivering the pressurized fuel in said pump chamber into said common rail and pressurizing the fuel in said common rail;

a spill solenoid valve which is provided in a path communicating said pump chamber with a low pressure fuel path and which, when opened, communicates said pump chamber with said low pressure fuel path and, when closed, delivers the fuel from said pump chamber into said common rail;

a cam which is secured to a driving shaft driven by the engine and which is provided with a plurality of rising slopes for driving said plunger so as to pressurize the fuel, the number of said rising slopes being greater than the number of fuel injections performed by said injection nozzle for each rotation of the engine; and control means for controlling the opening and closing of said spill solenoid valve, wherein said control means controls a closing timing of said spill solenoid valve during each period of time in which the delivery of the fuel is possible in one rotation of said cam, so that a period of synchronous delivery, in which the delivery is synchronized with the fuel injection of said injection nozzle, is equal to the entire period of time in which the delivery is possible, and so that a period of asynchronous delivery, in which the delivery is not synchronized with the fuel injection of said injection nozzle, is less than the entire period of time in which the delivery is possible, and said control means also controls the closing timing of said spill solenoid valve to adjust the period of said asynchronous delivery in accordance with a load on the engine, thereby maintaining the fuel pressure in said common rail to a predetermined pressure level.

5. A fuel injector system according to claim 4, wherein the cam has more projections on an outer periphery of the cam than the number of fuel injections of said injection nozzle for one rotation of the engine, so that the number of rising slopes for pressurizing fuel by said plunger is greater than the number of fuel injections of said injection nozzle.

6. A fuel injector system according to claim 4, wherein a plurality of cams which are provided with a plurality of projections on the outer peripheries thereof are disposed on said driving shaft, the projections on each cam being shifted with respect to each other in a rotational direction to form a greater number of rising slopes for pressurizing fuel by said plunger than the number of fuel injections of said injection nozzle.

* * * * *